US005544473A

United States Patent [19]

Maida et al.

[11] Patent Number: 5,544,473

[45] Date of Patent: Aug. 13, 1996

[54] PROTECTIVE SHIPPING OR MAILING ENVELOPES AND METHOD OF MAKING

[75] Inventors: Richard C. Maida, Staten Island; Joseph Sferlazza, West Hempstead, both of N.Y.

[73] Assignee: Prompac Industries, Inc., Staten Island, N.Y.

[21] Appl. No.: 306,458

[22] Filed: Sep. 15, 1994

[51] Int. Cl.[6] ..... B31B 39/00; B65B 11/00; B65B 61/22

[52] U.S. Cl. ..... 53/460; 53/472; 206/591; 229/87.03; 229/928; 493/217; 493/918

[58] Field of Search ..... 53/472, 460, 456, 53/206, 175, 170, 449; 493/918, 922, 217; 206/591; 229/928, 87.02, 87.03, 92, 928

[56] References Cited

U.S. PATENT DOCUMENTS

| | | | |
|---|---|---|---|
| 1,723,255 | 8/1929 | Rowe | 493/217 X |
| 2,689,079 | 9/1954 | Timer | 206/591 X |
| 2,728,479 | 12/1955 | Wheeler | 206/591 X |
| 3,285,401 | 11/1966 | May | 206/591 |
| 3,867,874 | 2/1975 | O'Neil | 493/217 |
| 4,011,798 | 3/1977 | Bambara et al. | 493/217 X |

*Primary Examiner*—James F. Coan
*Attorney, Agent, or Firm*—Scully, Scott, Murphy & Presser

[57] ABSTRACT

A first embodiment of the envelope comprises an outer envelope forming an interior, and a packing material secured in the interior of the outer envelope and forming a pocket for receiving an article. This packing material is comprised of a flexible and expandable packing material forming a multitude of slits arranged to allow the packing material to be pulled into a three-dimensional shape in which the packing material cushions and protects the article inside the packing material. A second embodiment of the envelope of this invention comprises a plurality of sections connected together to form an interior for holding an article; and each of these sections is comprised of a flexible and expandable paper material forming a multitude of slits to allow the sections to be pulled into three dimensional shapes in which those sections cushion and protect the article in the interior of the envelope. This envelope also includes a gripping panel connected to the expandable sections of the envelope to facilitate pulling those sections into their expanded shapes.

18 Claims, 5 Drawing Sheets

PROTECTIVE SHIPPING OR MAILING ENVELOPES AND METHOD OF MAKING

BACKGROUND OF THE INVENTION

This invention generally relates to shipping or mailing envelopes, and more particularly, to envelopes that are provided with packing or cushioning material to help protect fragile or breakable articles.

Cushioning material is often used to help protect articles that are shipped or mailed in envelopes. For instance, a person may wrap an article inside cushioning material and then place the wrapped article inside an envelope. Also, envelopes may be manufactured with cushioning material secured in the envelope, commonly in the form of a liner or inner envelope inside an outer envelope. In use, a person inserts an article inside the liner or inner envelope and then closes and mails the outer envelope.

Plastic sheets impregnated with a multitude of bubbles are a common cushioning material used in the above-discussed situations. This packing material, commonly referred to as bubble wrap, has several disadvantages, however. For example, toxic wastes are produced when these materials are made. In addition, these materials are not biodegradable and the disposal of these materials has become a significant environmental problem. Further, bubble wrap is somewhat bulky, and it is often not practical to store large quantities of bubble wrap for extended periods of time.

Small, peanut-shaped pieces of styrofoam are also used as packing material. These styrofoam peanuts are, as a general rule, too bulky to be used with most envelopes. Moreover, important environmental problems are also associated with the manufacture and disposal of these styrofoam peanuts. Folded or crumpled newspapers may also be used as a cushioning or packing material; however, newspapers are often not very effective for this purpose.

SUMMARY OF THE INVENTION

An object of this invention is to improve shipping and mailing envelopes.

Another object of the present invention is to provide an envelope with an effective, biodegradable cushioning material.

A further object 0f this invention is to provide an envelope with a protective liner that can be stored in a very thin, compact shape.

Another object of the present invention is to provide an envelope made from a thin, expandable, biodegradable material that may be expanded into a shape in which the envelope effectively cushions articles placed in the envelope.

Still another object of this invention is to improve procedures for making protective envelopes.

These and other objectives are obtained with a protective envelope constructed in accordance with the present invention. A first embodiment of the envelope comprises an outer envelope forming an interior, and a packing material secured in the interior of the outer envelope and forming a pocket for receiving an article. This packing material is comprised of a flexible and expandable packing material forming a multitude of slits arranged to allow the packing material to be pulled into a three-dimensional shape in which the packing material cushions and protects the article inside the packing material. A second embodiment of the envelope of this invention comprises a plurality of sections connected together to form an interior for holding an article; and each of these sections is comprised of a flexible and expandable paper material forming a multitude of slits to allow the sections to be pulled into three dimensional shapes in which those sections cushion and protect the article in the interior of the envelope. This envelope also includes a gripping panel connected to the expandable sections of the envelope to facilitate pulling those sections into their expanded shapes.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
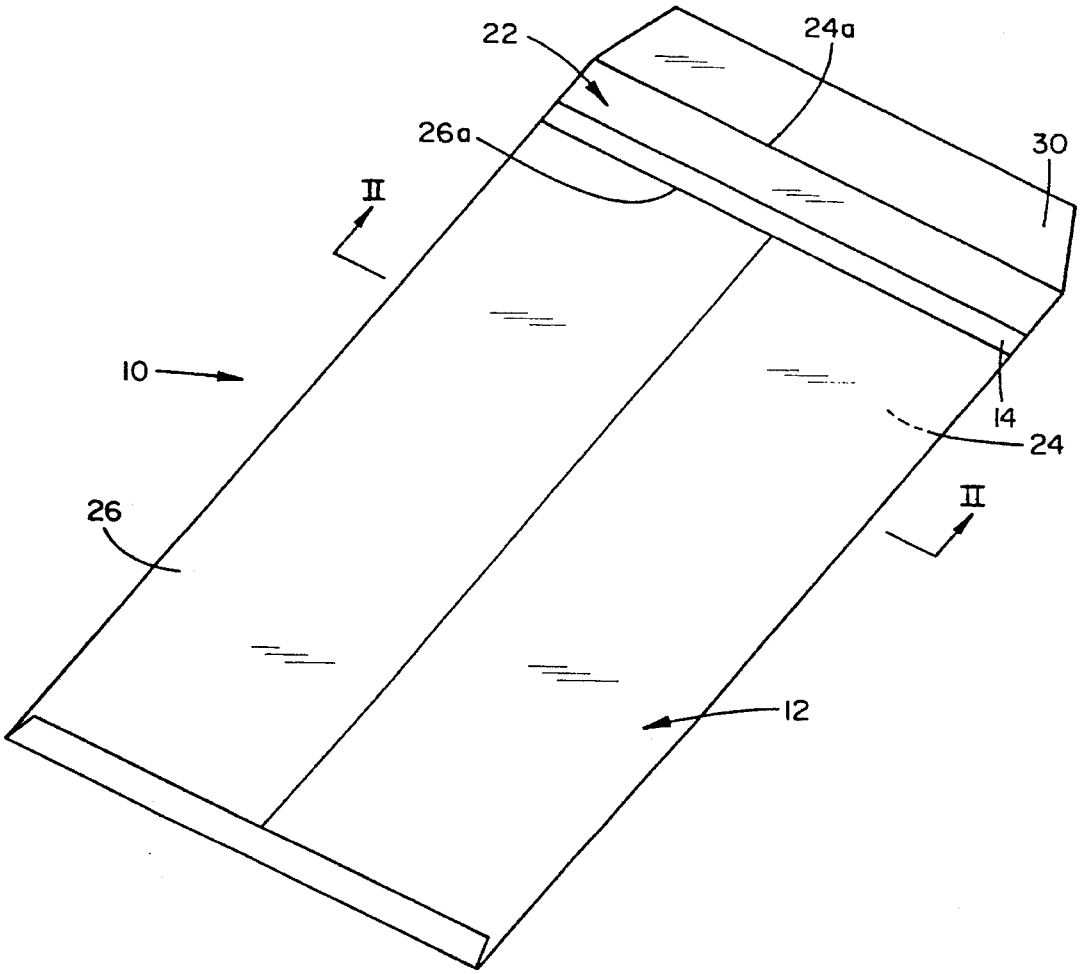
FIG. 1 is a perspective view of a protective envelope embodying the present invention.
Figure 2:
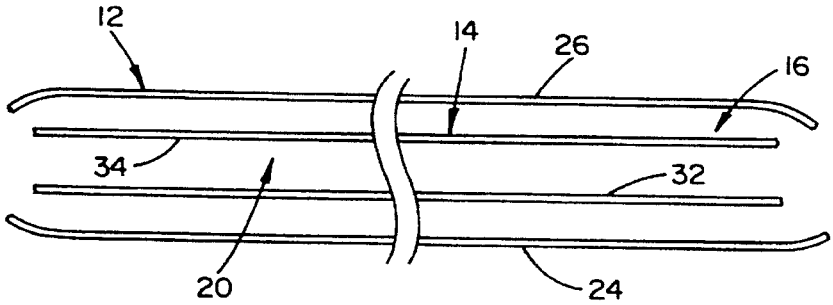
FIG. 2 is an exploded, cross-sectional view of the envelope shown in FIG. 1 and taken along line II—II thereof.

FIGS. 1 and 2 illustrate protective envelope 10 generally comprising outer envelope 12 and inner packing material 14. Outer envelope 12 forms interior 16, and packing material 14 is secured in that interior and forms pocket 20 for receiving an article. Packing material 14 is comprised of a flexible and expandable paper material having a multitude of slits arranged to allow the packing material to be pulled from a flat, planar shape and into a three-dimensional shape. In that three-dimensional shape, packing material 14 is both flexible and load-bearing, serving as an excellent cushion for an article in pocket 20.

With the embodiment of envelope 10 shown in FIGS. 1 and 2, outer envelope 12 substantially completely encloses interior 16 and packing material 14; however, preferably outer envelope 12 also forms a top opening 22 that provides access to interior 16 and to packing material 14 therein. More specifically, outer envelope 12 includes front and back sections 24 and 26; and bottom, left, and right edges of front section 24 are connected to the bottom, left and right edges of back section 26, respectively, to form an enclosure around interior 16. The top edge 24*a* of front section 24 is spaced above the top edge 26*a* of back section 26, and upper portions of sections 24 and 26 form opening 22. Closure flap 30 is connected to front section 24 of outer envelope 12 and is positioned and dimensioned so that this flap can be folded downward and into engagement with back section 26 to close the outer envelope, specifically top opening 22 thereof. Closure flap 30 may be provided with glue or other means to secure the flap to back section 26.

Outer envelope 12 may be made of any suitable material. In fact, the present invention is very well-suited to use standard, commercially available envelopes as outer envelope 12.

In addition, with this embodiment of envelope 10, packing material 14 includes front and back sections 32 and 34 that form an inner envelope inside outer envelope 12. Also, sections 32 and 34, specifically top edges thereof, form an opening 36 that provides access to pocket 20. Preferably, packing material 14 is arranged so that it is pulled upward, relative to outer envelope 12, in order to pull the packing material into its expanded shape. Further, sections 32 and 34 of packing material 14 preferably extend to a position above edge 26*a* of outer envelope 12, making it easier for a person to grip the top edges of sections 32 and 34 to pull those sections into their expanded, three-dimensional shapes.

Figure 3:
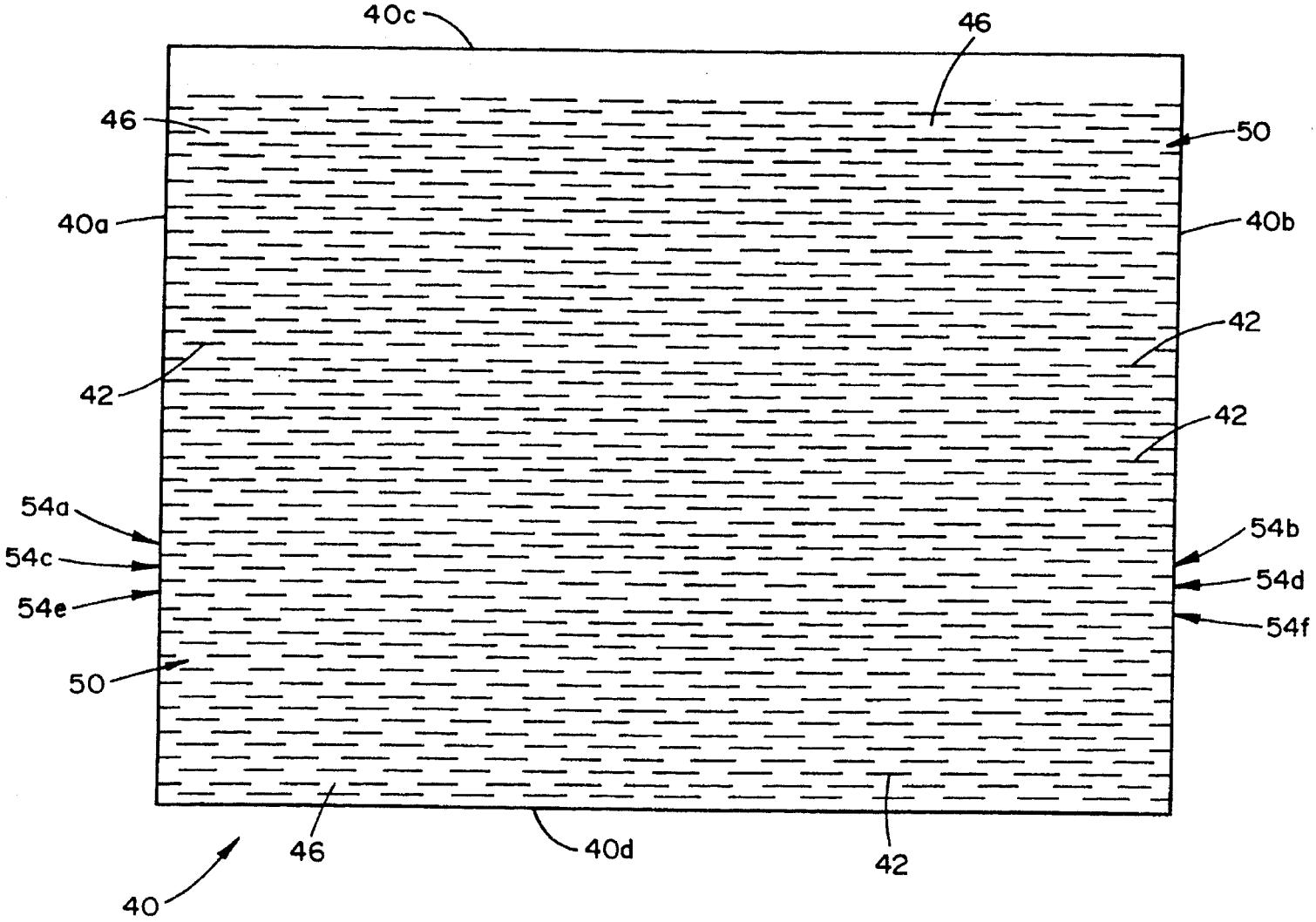
FIG. 3 is a top plan view of a sheet of expandable material used in the envelope of FIGS. 1 and 2.

Preferably, sections 32 and 34 of packing material 14 are formed from one sheet of packing material, shown at 40 in FIG. 3; and in particular, sections 32 and 34 are formed by folding that sheet 40. With reference to FIG. 3, sheet 40 is comprised of a paper or paper-like material and has a multitude of slits 42 arranged in a multitude of parallel rows. Six of these rows are referenced in FIG. 3 at 44*a*–44*f* respectively. The slits are positioned so that the slits of one row extend across the intervals or spaces between the slits of the adjacent row, producing a staggered arrangement of slits over sheet 40. Preferably, all of the slits have the same lengths. In addition, along the transverse axis of sheet 40, the slits are uniformly spaced apart; and along the longitudinal axis of sheet 40, the rows of slits are also uniformly spaced apart.

The rows of slits in sheet 40 can be considered as being comprised of two groups. The slits in the rows of each group are directly aligned with each other in the direction of the longitudinal axis of sheet 40, and the rows of slits in sheet 10 alternative between rows of the first group and rows of the second group. Thus, for example, rows 44*a*, 44*c*, and 44*e* are in the first group of rows; and rows 44*b*, 44*d*, and 44*f* are in the second group of rows. The rows are positioned in sheet 40, for example, with row 44*b* between rows 44*a* and 44*c*, with row 44*c* between rows 44*b* and 44*d*, and with row 44*d* between rows 44*c* and 44*e*.

More specifically, sheet 40 has a generally rectangular shape, including as viewed in FIG. 3, generally parallel left and right sides or edges 40*a* and 40*b*, and generally parallel top and bottom sides or edges 40*c* and 40*d*. Each row of slits transversely extends across sheet 40, between edges 40*a* and 40*b*, and the sheet form a short land 46 between each pair of transversely adjacent slits. Because the slits are uniformly spaced apart, all of the lands 46 have the same length $d_1$. Sheet 40 also form a land 50 between each pair of adjacent rows of the slits; and because the rows are uniformly spaced apart, all of the lands 50 have the same width $d_2$.

Although preferably all of the slits have the same length, that length may vary over a wide range. Similarly, although the slits are uniformly spaced apart a distance $d_1$, and the rows of slits are uniformly spaced apart a distance $d_2$, those distances $d_1$ and $d_2$ may also vary over wide ranges. For example, with the embodiment of sheet 40 shown in FIG. 3, the slits are ½ inch long, adjacent slits are transversely spaced apart 3/16 of an inch, and the rows are spaced apart ⅛ inch.

Figure 4:
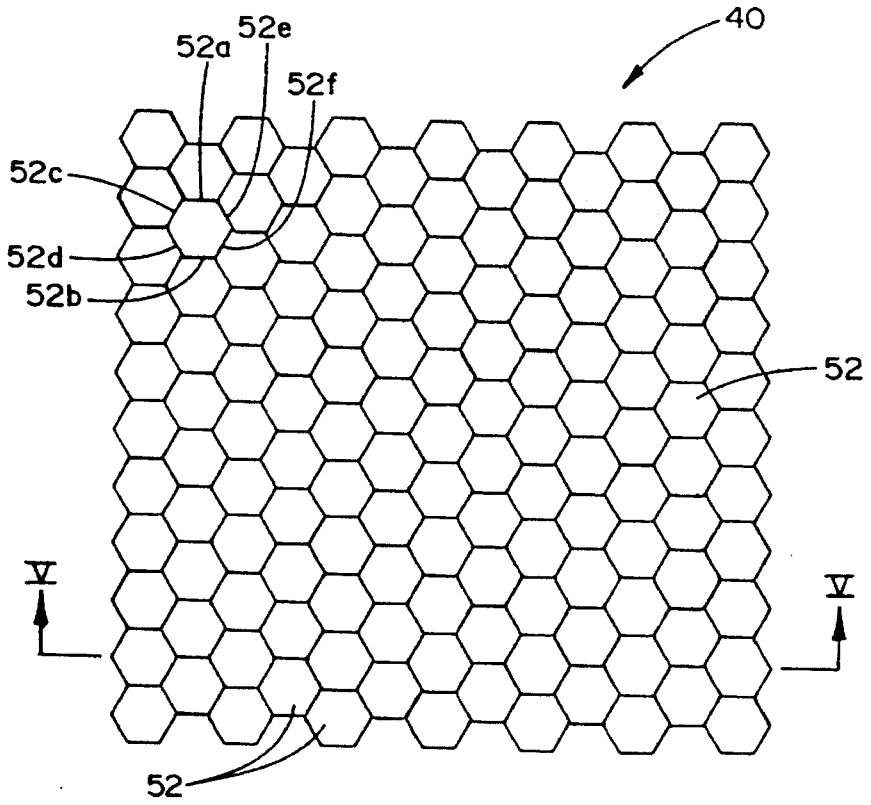
FIG. 4 is a top view of a portion of the material shown in FIG. 3 after that material has been expanded into a three-dimensional shape.
Figure 5:
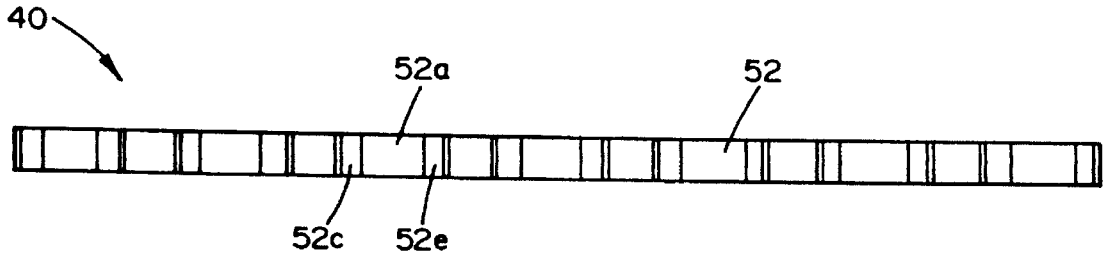
FIG. 5 is an enlarged, cross-sectional view of the material shown in FIG. 3, taken along line IV—IV thereof.

Slits 42 are provided in sheet 40 to allow that sheet to be pulled into a three-dimensional shape comprised of a multitude of hexagonal cells, as shown in FIGS. 4 and 5. More specifically, with reference to FIGS. 3 and 4, to pull the sheet into this shape, edges 40*c* and 40*d* are pulled apart along the longitudinal axis of the sheet. As this happens, each slit 42 is pulled open into a hexagonal cell 52; and the land segments 50 on opposite sides of each slit are pulled apart, twisted into a direction approximately 45° to the original plane of sheet 40, and also pulled into a shape forming the sides of the hexagonal cell formed from the slit.

The lengths $d_3$ of the top and bottom edges 52*a* and 52*b* of that hexagonal cell 52 are each equal to the length of land 46; and the length, $d_4$, of each of the other four sides 52*c*, 52*d*, 52*e*, and 52*f* of the hexagonal cell 52 is equal to ½ the length of the slit minus the length of land 46; that is $d_4=½(s-d_1)$. With the specific size and arrangement of slits 42 in sheet 40, that sheet forms a honeycomb shape when it is expanded, in which each of the cells 52 is comprised of six equal length sides. As will be understood by those of ordinary skill in the art, the sides of cells 22 may have unequal lengths.

Sheet 40 may be made of a multitude of types of materials. The important consideration is that, when the material is provided with slits 42 and then pulled in a direction perpendicular to the direction of the lengths of those slits, the material expands into a three dimensional shape that is both resilient and load bearing and comprised of a multitude of open cells. Preferably, this material is a fibrous, paper material, and the present invention is very well suited for use with recycled paper. For instance, sheet 40 may be a paper material of the type referred to as a zero nip stock, which contains strong, bulky fibers. The strength and weight of the material of sheet 40 may vary over wide ranges, though. It is preferred that the lengths of the slits 42 be perpendicular to the direction of the grain of sheet 10. Sheet 40 may be formed in any appropriate manner; and, for example, one acceptable procedure for making sheet 40 is disclosed in copending patent application No. 08/213,993 now U.S. Pat. No. 5,365,819, the disclosure of which is herein incorporated by reference.

Figure 6:
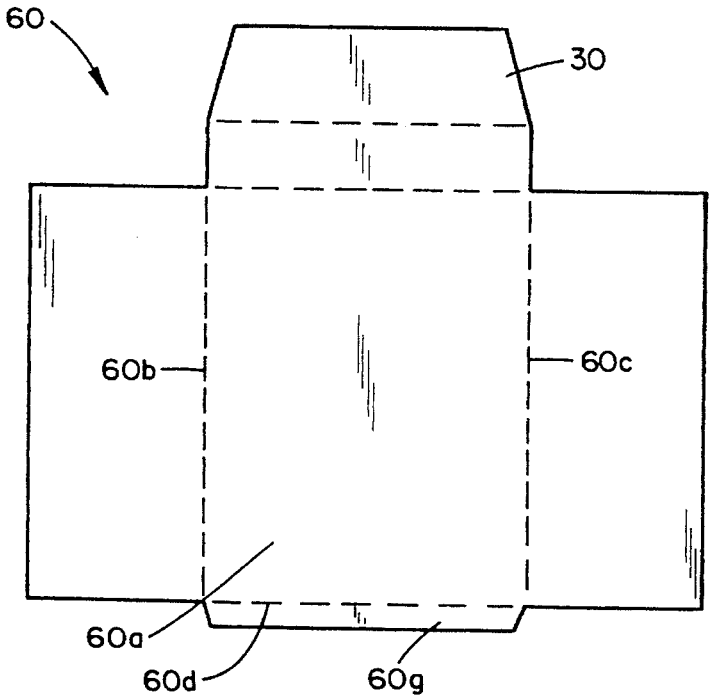
FIG. 6 shows a blank for forming the outer envelope of the envelope illustrated in FIG. 1.
Figure 7:
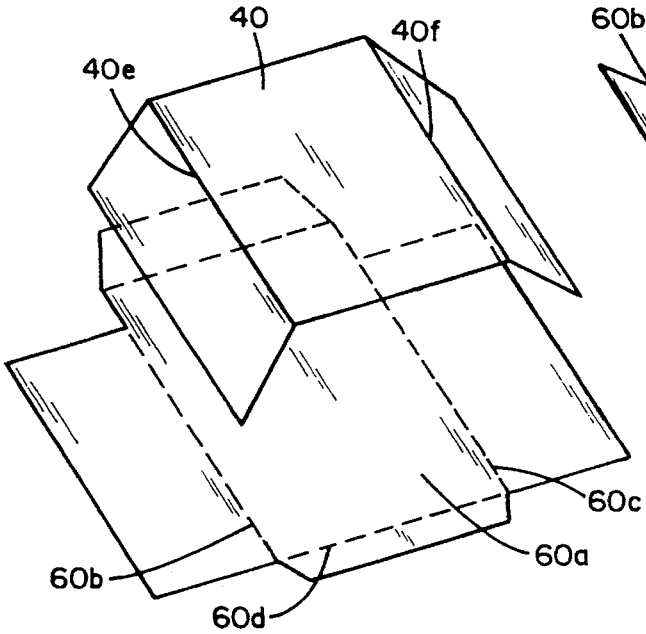
FIGS. 7 and 8 illustrate a procedure for making the envelope of FIG. 1.
Figure 8:
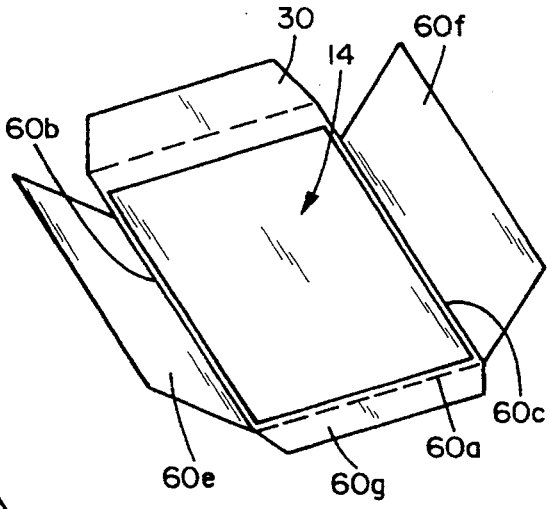

FIGS. 6–8 illustrate a procedure for making protective envelope 10. In accordance with this procedure, inner envelope is formed from sheet 40 and outer envelope is formed from blank 60. More specifically, sheet 40 is folded into the shape of inner envelope and connected to blank 60, which is then folded about the packing material to form outer envelope 12 enclosing that packing material.

With particular reference to FIG. 7, inner envelope 14 is formed by folding left and right end portions of sheet 40 about fold lines 40*e* and 40*f* and toward each other. Preferably, fold lines 40*e* and 40*f* are perpendicular to the direction of rows 44 of slits. Also, preferably, these end portions, after being folded together, overlap slightly, forming a back section 24 that extends from fold line 40*e* to fold line 40*f*. These overlapping end portions may be connected together, although this is not necessary.

After inner envelope 14 is formed, that inner envelope is placed on a center section 60*a* of blank 60. Preferably, the width of inner envelope 14 is slightly less than the width of center section 60*a*; and the inner envelope is placed on section 60*a*, generally centered between the left and right edges thereof, which are formed by fold lines 60*b* and 60*c*. Also, the bottom edge of inner envelope 14 is located slightly above the bottom edge of center section 60*a*, which is formed by fold line 60*d*.

Then, with reference to FIG. 8, left and right end flaps 60*e* and 60*f* of blank 60 are folded toward each other, about fold lines 60*b* and 60*c*, and over inner envelope 14. Preferably, these flaps 60*e* and 60*f* are dimensioned so that, after being folded together, these flaps overlap slightly; and the end flaps 60*e* and 60*f* are connected together, for example by gluing together overlapping portions thereof. After flaps 60*e* and 60*f* are folded together, bottom flap 60*g* is then folded about fold line 60*d* and onto flaps 60*e* and 60*f*. Flap 60*g* may then be secured, for example by gluing, to the lower portions of flaps 60*e* and 60*f* to close the bottom of envelope 10.

In use, a person pulls sections 32 and 34 upwards relative to outer envelope 12 to twist those sections into three-dimensional honeycomb shapes, and an article is placed between the expanded sections 32 and 34. Envelope 10 may then be closed using top flap 30. With particular reference to FIGS. 1 and 3, preferably the upper portions of sections 32 and 34—which are formed from sheet 40—are free of slits 42. As a result, those upper portions of sections 32 and 34 are comparatively strong, and a person can grip the centers of these upper portions and effectively pull the complete widths of sections 32 and 34 outward and into the expanded, honeycomb shapes.

When sections 32 and 34 are expanded in the above-discussed manner, these sections are both flexible and load bearing, providing excellent cushioning and protection for articles positioned within pocket 20. Moreover, prior to being expanded, sections 32 and 34 have a very thin, flat shape. Because of this, envelope 10 also is comparatively thin and flat, and a multitude of such envelopes are very easy to store. Also, packing material 14 may be made from biodegradable materials without the use of any toxic chemicals.

Figure 9:
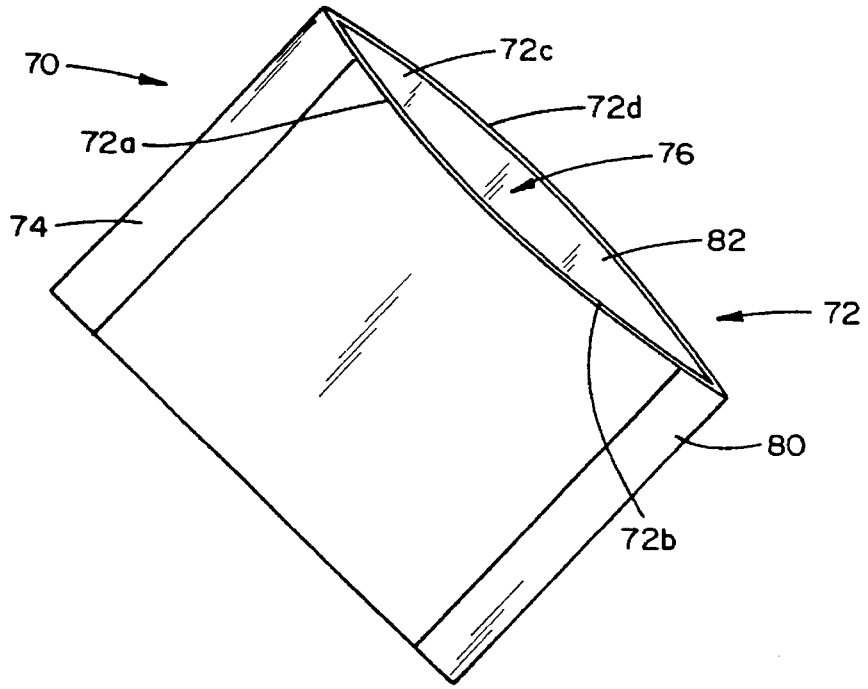
FIG. 9 is a perspective view of another envelope embodying the present invention.

FIG. 9 shows another protective envelope 70 made from packing material 20. Envelope comprises a plurality of sections 72 of packing material, and at least one gripping panel 74. Sections 72 are connected together to form an interior 76 for holding an article; and each of these sections 72 is comprised of a flexible and expandable paper material forming a multitude of slits arranged to allow the packing material to be pulled from a flat, planar shape and into a three-dimensional, flexible and load-bearing shape. Gripping panel 74 is connected to sections 72 to facilitate pulling those sections into their expanded, three-dimensional shape. Preferably, in sections 72, the rows of slits extend in a first direction, and gripping panel 74 is connected to sections 72 to facilitate pulling those sections in a direction generally perpendicular to that first direction.

With the embodiment of envelope 70 shown in FIG. 9, the plurality of sections 72 include four sections 72*a*, 72*b*, 72*c*, and 72*d*; and, also, this embodiment of envelope includes a second gripping panel 80. Sections 72*a*, 72*b*, 72*c* and 72*d* are substantially coterminus and have coextensive perimeters. Panels 74 and 80 are wrapped around and are connected to, respectively, the right edge portions and the left edge portions of at least outer sections 72*a* and 72*d*. In this way, panels 74 and 80 connect sections 72*a*, 72*b*, 72*c*, and 72*d* together and close the left and right edges of interior 76. The bottom edges of sections are also connected together so that the sections generally enclose interior.

Sections 72, specifically top edges thereof, preferably also form an opening 82 that provides access to interior 76. Furthermore, sections 72 are preferably arranged so that the rows of slits in each section extend longitudinally across each section, from the top to the bottom of the section. In this way, gripping panels 74 and 80 not only close the left and right edges of envelope 70, but also facilitate pulling the left edges of sections 72 away from the right edges of those sections to expand those sections into their three-dimensional shapes.

Figure 10:
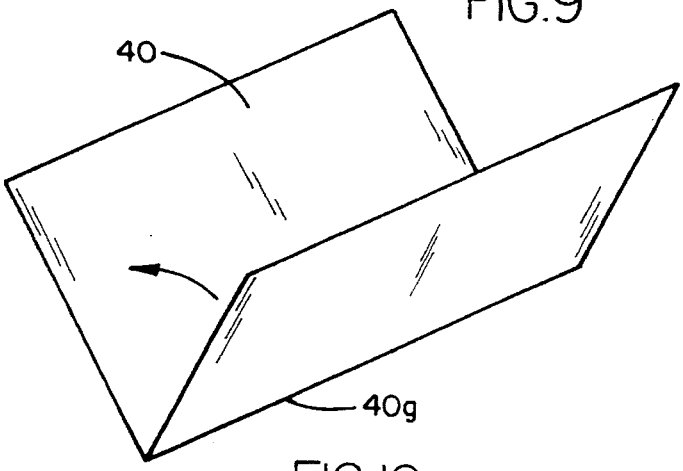
FIGS. 10–12 illustrate a procedure for making the envelope of FIG. 9.
Figure 12:
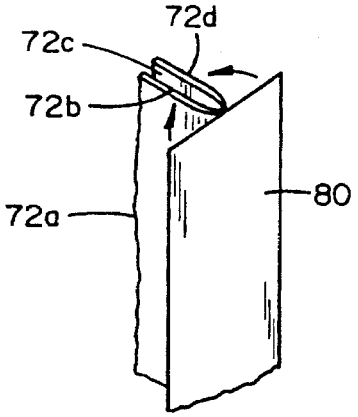
Figure 11:
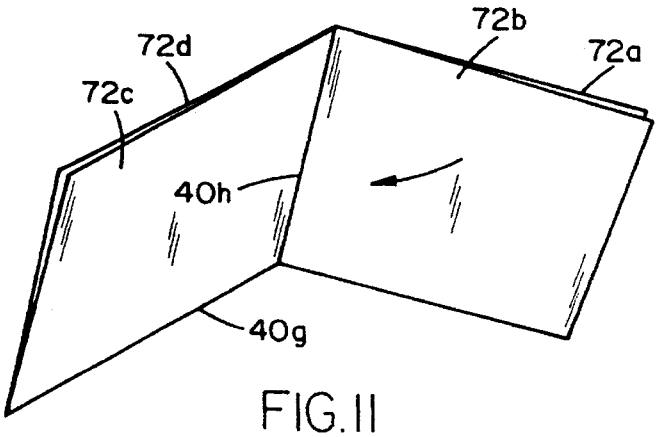

FIGS. 10–12 illustrate a procedure for making envelope 70. In this procedure, a sheet 40 of material is folded in half about fold line 40*g*, and then folded in half again about a second fold line 40*h*, perpendicular to the first fold line, to form sections 72*a*, 72*b*, 72*c*, and 72*d*. Gripping panels 80 and 84 are then wrapped around and connected to, for example by gluing, to the right and left edges of at least outer sections 72*a* and 72*d*. One difference between the way in which envelopes 10 and 70 are made is that the rows 44 of slits are arranged in different, perpendicular directions in the two envelopes. In particular, in envelope 10, each row 44 of slits extends transversely across the envelope, from the left edge to the right edge of the envelope. In envelope 70, each row 44 of slits extends longitudinally across the envelope, from the top edge to the bottom edge of the envelope. Also, with envelope 70, it is not necessary to provide sections 72 with any portion or strip that is free of slits 42, and, if desired, the sections 72 can be provided with slits 42 over the complete areas of those sections.

As will be appreciated by those of ordinary skill in the art, envelope 70 may have more or fewer than four sections 72, and in particular the envelope may be made from two sections. Also, the sections 72 of the embodiment of envelope 70 disclosed herein in detail may be made from more than one sheet 40 of material; and, for example, two or four separate sheets of material may be used to form these sections 72.

In use, a person pulls gripping panels 74 and 80 in opposite directions, expanding and twisting sections 72*a*, 72*b*, 72*c*, and 72*d* into three-dimensional shapes, and an article is placed in interior 76, between packing sections 72*b* and 72*c*. The entire envelope 70, including the article placed there inside, may then be inserted into another envelope, such as a standard commercial envelope, for mailing or shipping.

While it is apparent that the invention herein disclosed is well calculated to fulfill the objects previously stated, it will-be appreciated that numerous modifications and embodiments may be devised by those skilled in the art, and it is intended that the appended claims cover all such modifications and embodiments as fall within the true spirit and scope of the present invention.

What is claimed is:

1. A protective envelope comprising:

an outer envelope forming an interior and a top back edge; and a packing material secured in the interior of the outer envelope and forming a pocket for receiving an article, wherein the packing material is comprised of a flexible and expandable paper material forming a multitude of slits arranged to allow the packing material to be pulled into a three-dimensional shape, and wherein the packaging material extends above the top back edge of the outer envelope to facilitate pulling the packing material into said three-dimensional shape.

2. A protective envelope according to claim 1, wherein:

the packing material includes a left edge, a right edge, and a top edge transversely extending between the left and right edges of the packing material;

the multitude of slits in the packing material are arranged in a multitude of parallel rows transversely extending across the packing material; and the top edge of the packing material extends above the top, back edge of the outer envelope.

3. A protective envelope according to claim 2, wherein the packing material includes a solid top portion having none of the slits and extending downward from the top edge of the packing material, to facilitate pulling the packing material into the three-dimensional shape.

4. A protective envelope comprising:

an outer envelope extending in longitudinal and transverse directions, having a transversely extending top edge, and forming an interior and an opening at said top edge providing access to said interior; and a packing material disposed in the interior of the outer envelope and forming a pocket for receiving an article;

wherein the packing material is comprised of a flexible and expandable paper material forming a multitude of slits, and said slits are arranged in a multitude of transversely extending rows; and wherein when the packing material is pulled in the longitudinal direction, the packing material expands in a direction perpendicular to both the longitudinal and transverse directions, into a three-dimensional shape, to form a protective cushion for said article.

5. A protective envelope according to claim 4, wherein the outer envelope has a thin flat shape defining a plane, and when the packing material is pulled in the longitudinal direction the packing material expands in a direction perpendicular to said plane.

6. A method of forming a protective envelope, comprising:

providing an envelope blank;

folding the envelope blank into an outer envelope having a top, back edge;

shaping a packing material to form a pocket for receiving an article, the packing material being comprised of a flexible and expandable paper material forming a multitude of slits arranged to allow the packing material to be pulled into a three-dimensional shape; and securing the packing material inside the outer envelope with the packing material extending above the top, back edge of the outer envelope to facilitate pulling the packing material into said three-dimensional shape.

7. A method according to claim 5, wherein:

the folding step includes the step of forming the outer envelope with an interior; and the securing step includes the step of securing the packing material in the interior of the outer envelope, with the packing material extending outside the interior of the outer envelope to facilitate pulling the packing material into said three-dimensional shape.

8. A method of packaging an article, comprising:

providing a shipping envelope including an outer envelope and first and second sections of packing material, located opposite each other and inside the outer envelope, each of said first and second sections of packing material being comprised of a resilient and flexible paper material having a multitude of slits arranged to allow said sections to be pulled into three-dimensional shapes;

placing the article between the first and second sections of packing material; and pulling the first and second sections of packing material into three-dimensional shapes to form a protective enclosure for the article; and wherein each of the sections Of the packing material includes a solid top portion having none of the slits, and the pulling step includes the step of gripping and pulling said top portions of the sections of the packing material to pull said sections into said three-dimensional shapes.

9. A method according to claim 8, wherein:

each of the sections of packing material includes a solid top portion having none of the slits; and the pulling step includes the step of gripping and pulling said top portions of the sections of packing material to pull said sections into said three-dimensional shapes.

10. A protective envelope comprising:

a plurality of sections connected together to form an interior for holding an article, each of said sections being comprised of a flexible and expandable paper material forming a multitude of slits to allow the section to be pulled into a three-dimensional shape; and a gripping panel connected to the sections to facilitate pulling said sections into the three-dimensional shapes.

11. An envelope according to claim 10, wherein:

each of the sections includes left and right edges;

the gripping panel includes a right gripping panel connected to the right edges of the sections; and the envelope further comprises a left gripping panel connected to the left edges of the sections to further facilitate pulling the sections into the three-dimensional shapes.

12. An envelope according to claim 11, wherein:

the slits are arranged in a multitude of parallel rows, said rows extending in a first direction; and the gripping panel extends along the sections in the first direction to facilitate pulling the sections in a second direction generally perpendicular to said first direction.

13. A method of packaging an article comprising: providing a shipping envelope including (i) an outer envelope extending in longitudinal and transverse directions, and (ii) first and second sections of packing material located opposite each other inside the outer envelope, each of said first and second sections of packing material being comprised of a resilient and flexible paper material having a multitude of slits arranged to allow said section to be pulled into a three-dimensional shape, wherein the outer envelope has a transversely extending top edge and forms an opening at said top edge providing access to inside the outer envelope, and said slits are arranged in a multitude of transversely extending rows;

placing the article between said first and second sections of the packing material; and pulling the first and second sections in the longitudinal direction to expand the first and second sections in a direction perpendicular to both said longitudinal and transverse directions, into three-dimensional shapes, to form a protective enclosure for the article.

14. A method according to claim 13, wherein the outer envelope has a thin flat shape defining a plane, and the pulling step includes the step of pulling the first and second sections in the longitudinal direction to expand the first and second sections in a direction perpendicular to said plane.

15. A method of forming a protective envelope, comprising:

providing a sheet of paper material having a multitude of slits arranged to allow the sheet to be pulled into a three-dimensional shape;

folding the sheet about a fold line to form first and second sections; and connecting together left edges of the sections and connecting together right edges of the sections to form an interior, between said sections, for receiving an article;

wherein the step of connecting the left edges includes the step of connecting an end panel to the left edges of the sections to connect said left edges together and to facilitate pulling the sections into three-dimensional shapes.

16. A method according to claim 15, wherein:

the providing step includes the step of providing a sheet of paper material having a multitude of slits arranged in a multitude of parallel rows, extending in a first direction; and the folding step includes the step of folding the sheet about a fold line extending generally perpendicular to said first direction.

17. A method of packaging an article, comprising:

providing an envelope including a front section, a back section and a gripping panel extending over and connecting together the front and back sections, wherein the front and back sections form an interior and an opening providing access to said interior, and each of the front and back sections is comprised of a paper material having a multitude of slits to allow the section to be pulled into a three-dimensional shape;

placing the article in said interior; and gripping and pulling the gripping panel to pull the front and back sections into three-dimensional shapes to form a protective enclosure for the article.

18. A method according to claim 17, wherein:

the multitude of slits in the front and back sections are arranged in a multitude of rows extending in a first direction; and the pulling step includes the step of pulling the front and back sections in a direction perpendicular to said first direction.

* * * * *